US011725848B2

(12) United States Patent
Guo

(10) Patent No.: US 11,725,848 B2
(45) Date of Patent: Aug. 15, 2023

(54) INFLATED WATER STORAGE DEVICE OF HEATER

(71) Applicant: NEXWATER INC., Taipei (TW)

(72) Inventor: Hong-Yi Guo, Taipei (TW)

(73) Assignee: NEXWATER INC., Taipei (TW)

( * ) Notice: Subject to any disclaimer, the term of this patent is extended or adjusted under 35 U.S.C. 154(b) by 0 days.

(21) Appl. No.: 17/475,530

(22) Filed: Sep. 15, 2021

(65) Prior Publication Data

US 2022/0252301 A1 Aug. 11, 2022

(30) Foreign Application Priority Data

Feb. 9, 2021 (TW) ..... 110201694

(51) Int. Cl.
*F24H 1/18* (2022.01)

(52) U.S. Cl.
CPC ..... *F24H 1/188* (2013.01)

(58) Field of Classification Search
CPC . F24H 1/188; F24H 1/181; F24H 1/18; F24H 1/10; F24H 1/0072; B65D 47/06; F24D 17/00
See application file for complete search history.

(56) References Cited

U.S. PATENT DOCUMENTS 3,891,124 A * 6/1975 Dreibelbis ..... F24D 17/00 222/66
6,847,782 B1 * 1/2005 Kovacs ..... F24H 1/188 392/441
11,148,928 B1 * 10/2021 Huang ..... F24H 1/188

FOREIGN PATENT DOCUMENTS

GB 2458826 A * 10/2009 ..... F24D 3/1008

* cited by examiner

*Primary Examiner* — Edelmira Bosques
*Assistant Examiner* — Brett Peterson Mallon

(57) ABSTRACT

An inflated water storage device of a heater is located on a heating container, includes: an adjusting bag which has a storage cavity made of a soft and elastic material, and a connection tube body, each end of which is respectively connected with an inlet and an outlet, so as to be connected to the inlet pipeline on the heating container, and the connection tube body has a circulation tube connected with the storage cavity in the adjusting bag. When cold water flow into the inlet pipeline, water and air in the storage cavity will be sucked out and deformed to shrink to form a negative pressure, used to recover and absorb hot water and water vapor, and to make the adjusting bag store water swell and deform, so that the simple and effective structure can achieve energy saving and drip-proof practical effect.

5 Claims, 6 Drawing Sheets

INFLATED WATER STORAGE DEVICE OF HEATER

BACKGROUND OF THE INVENTION

Field of the Invention

This present invention relates to the energy-saving technology field of a heater, in particular to an inflated water storage device of a heater.

The Prior Arts

In the traditional prior art knowledge of the kitchen-type hot water storage device of the heater, mainly an inlet pipe and an outlet unit are connected to a heating container, wherein the inlet pipe is connected to an outlet valve of an outlet faucet, when the user opens the outlet unit, the cold water in the inlet pipe will flow into the heating container, and is heated to be hot water by the heating container, then flow from the outlet unit for use.

However, when the user closes the outlet unit, the water in the heating container will be heated to be hot water, because of thermal expansion and heat gas rise, the hot water in the heating container and water vapor will rise and gather, resulting in trouble about the outlet of the outlet unit easy to drip when not used, while the heat inside the container will continue to be dissipated, must be frequently started to re-heating action, so that the waste of many energy does not help environmental protection.

Therefore, the prior arts are provided an inflated water storage device of the heater, which is stacked in multilayer with a bottom shell, a pressure film, and a upper shell, wherein, the bottom shell is set up a storage tank corresponding pressure film, which is located on a heater, when the heater is heat, so as to the inflated hot water in the heater to be sucked into the storage tank by the pressure film, then recover and storage inflated hot water, to achieve energy-saving effect and prevent dripping effect. However, its structure is complex, many parts, high cost, assembly is very troublesome, the overall design is not perfect, as its main shortcomings.

SUMMARY OF THE INVENTION

In view of foregoing, the main purpose of this creation is to provide an inflated water storage device of a heater, which is located on a heating container, which mainly includes: an adjusting bag and a connection tube body, wherein the heating container is connected with an inlet pipeline and an outlet unit.

The adjusting bag, which is correspondingly located on a heating container, has a storage cavity made of a soft elastic material.

The connection tube body, the two ends of which are respectively connected with an inlet and an outlet to be connected to the inlet pipeline on the heating container, and the connection tube body has a circulation tube connected with the storage cavity in the adjusting bag.

Thus, when the outlet unit of the heating container is opened, the cold water flowing into the inlet pipeline passes rapidly through the connection tube body, the water and air in the storage cavity of the adjusting bag will be sucked out and form a vacuum, which will cause the adjusting bag to contract and deform, and when the outlet unit is closed, the storage cavity will naturally form negative pressure, which can be used to recover and absorb hot water and water vapor that is hotly expanded by heating in the heating container, and to make the adjusting bag store water swell and deform, so that the simple and effective structure can achieve energy saving and drip-proof practical effect.

DETAILED DESCRIPTION OF THE PREFERRED EMBODIMENT

Figure 1:
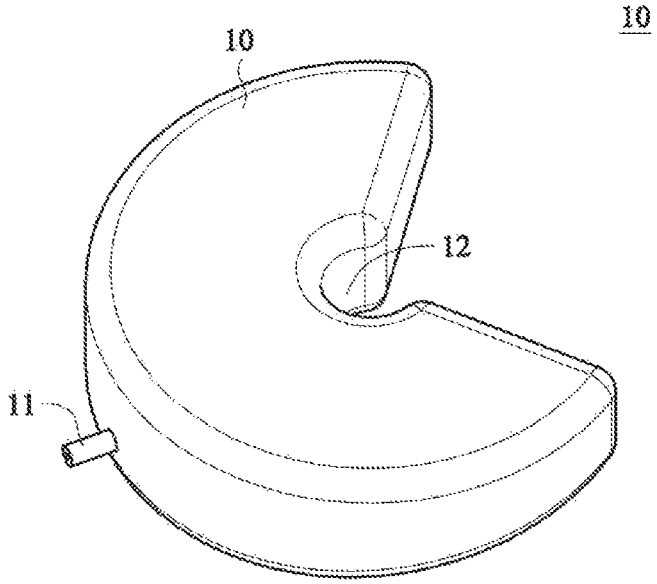
FIG. 1 is a three-dimensional schematic of the present invention.
Figure 2:
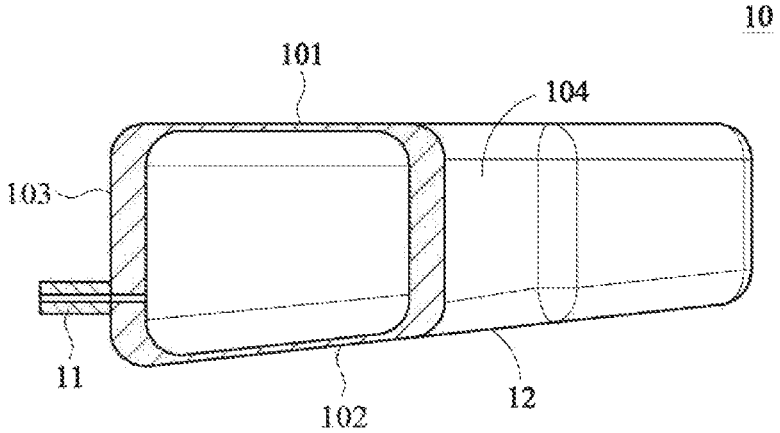
FIG. 2 is a sectional view schematic of the present invention.

In order to facilitate the understanding of the content of this creation, and achieve the effect, cooperate with the schematic to list specific embodiments, detailed as follows:

Please refer FIGS. 1 to 4, the three-dimensional schematic, the section view schematic, the assembly schematic, and the application of the three-dimensional schematic, one of the creations of the inflated water storage device 100, is located on a heating container 50, includes: an adjusting bag 10, and a connection tube body 20, wherein the heating container 50 is connected with an inlet pipeline 40 and an outlet unit 60.

The adjusting bag 10, which is correspondingly located on a heating container 50, has a storage cavity 15 made of a soft elastic material, such as rubber, PU (Polyurethane), silicone and other resin materials, but actually not limited to foregoing.

The connection tube body 20, the two ends of which are respectively connected with an inlet 21 and an outlet 22 to be connected to the inlet pipeline 40 on the heating container 50, and the connection tube body 20 has a circulation tube 23 connected with the storage cavity 15 in the adjusting bag 10.

Preferable embodiment, wherein the connection tube body 20 is a Venturi tube, the connection tube body 20 has a neck portion 25 at the adjacent position of the circulation tube 23 toward the side of the inlet 21, the diameter of the neck portion 25 is less than the diameter of the connection tube body 20, but in fact does not as a limit.

Preferable embodiment, wherein the storage cavity 15 of the adjusting bag 10 is further provided with a junction tube 11 to be connected the circulation tube 23.

Preferable embodiment, wherein the adjusting bag 10 further has an accommodating-tube portion 12 clamped on the pipeline of the outlet unit 60.

Preferable embodiment, wherein the adjusting bag 10 is further set up to be a streamlined concave shape, the adjusting bag has an upper bag surface 101, a bottom bag surface 102, an outer bag surface 103, and a concave bag surface 104.

Preferable embodiment, but in fact the shape does not as a limit. wherein the adjusting bag 10 is further set up to be a C-shape body, a junction tube 11 is located in the outer bag surface 103, an accommodating-tube portion 12 is located in the concave bag surface 104, and the bottom bag surface 102 is tilted from high position inside to low position outside, so that different deformation height is on both sides in the storage cavity 15, in the movement, which can accelerate the internal water and air discharge, and avoid internal moisture residue.

Figure 3:
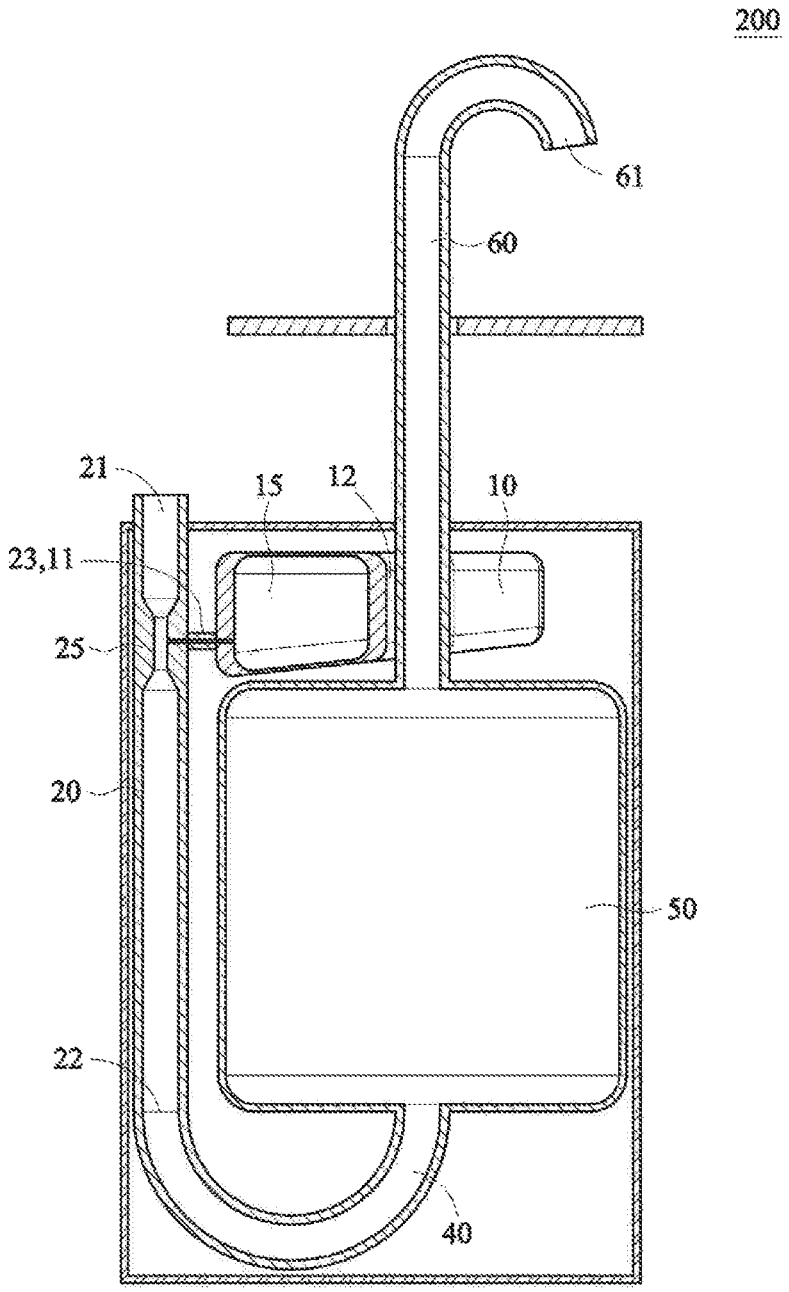
FIG. 3 is an assembly schematic of the present invention.
Figure 4:
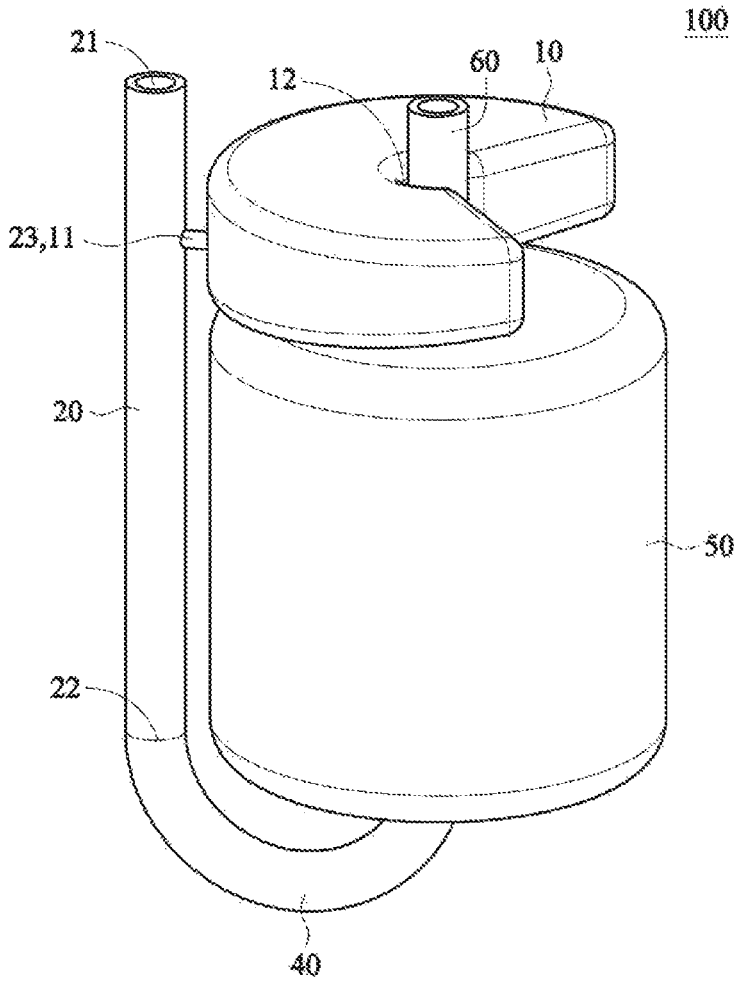
FIG. 4 is the application of stereoscopic schematic of the present invention.

More specific implementation instructions, please refer to FIG. 3 and FIG. 4 as shown, is the assembly schematic of this creation, the application of three-dimensional schematic, the creation of the heater inflated water storage device 100 can be installed on a kitchen-type heater 200, the heater 200 has a heating container 50, and the heating container 50 is connected to an inlet pipeline 40 and an outlet unit 60, in this embodiment, the inlet 21 and the outlet 22 of the connection tube body 20 which is connected to the inlet pipeline 40. The inflated water storage device 100 of the heater may be connected to the inlet pipeline 40, so that the flow of water to the inlet pipeline 40 may be passed by the connection tube body 20.

The overall structure design of the present creation is exquisite and simple, when assembled, so that the adjusting bag 10 can be easily installed configuration, stacked on the heating container 50, and uses streamlined concave shape accommodating-tube portion 12 to be clamped in the outlet unit 60. And use the connection tube body 20 to be connected on the inlet pipeline 40 of the heating container 50, and the junction tube 11 is connected to the circulation tube 23 of the connection tube body 20, so that connected with the adjusting bag 10 storage cavity 15.

Figure 5:
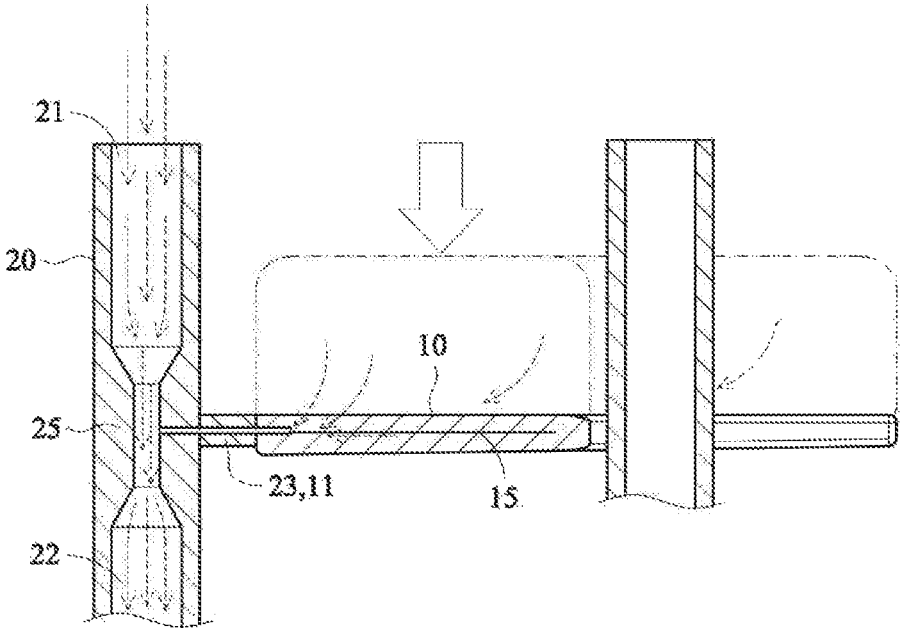
FIG. 5 is a dynamic action schematic of the present invention, show the shrinkage and deformation state of the adjusting bag, when the water enters the heater.
Figure 6:
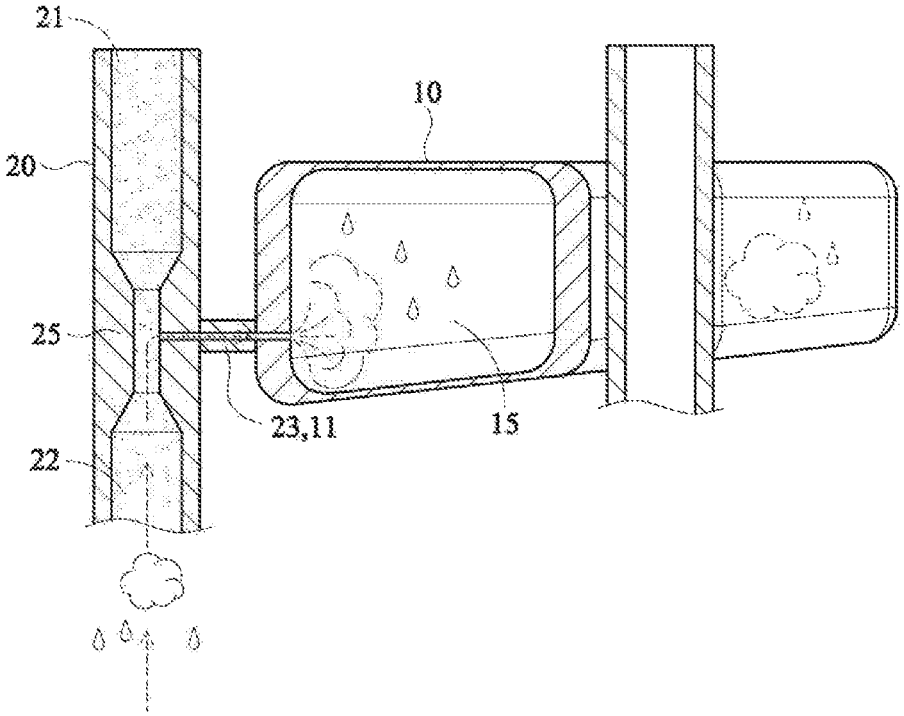
FIG. 6 is a dynamic action schematic of the present invention, show the inflated and deformation state of the adjusting bag, when the heater is heated.

When applying, please refer to FIG. 1 to FIG. 6, wherein FIG. 5 as shown is a schematic of the action of the present creation, shown the state for the shrinkage deformation of the adjusting bag when the water is entered in the heater. And FIG. 6 is a schematic of the action of the present creation, shown the state for the shrinkage deformation of the adjusting bag when the heater is heated. When the outlet unit 60 of the heater 200 is opened, the cold water flowing to the inlet pipeline 40 will quickly pass through the connection tube body 20, because the connection tube body 20 is a Venturi tube, the connection tube body 20 has a neck portion 25 at the adjacent position of the circulation tube 23 toward the side of the inlet 21, wherein the diameter of the neck portion 25 is less than the diameter of the connection tube body 20, so that the water flow will produce an acceleration effect when passes through the connection tube body 20 and form a negative pressure, through the neck portion 25 and take away the water and air within the storage cavity 15, so as to the storage cavity 15 space in the adjusting bag 10 is vacuumed, At this moment, the adjusting bag 10 will be shrink and deform due to negative pressure.

When the outlet unit 60 stops pumping water, the water flow will stop flowing and cause the negative pressure to disappear, at this time, because the adjusting bag 10 itself which has the elasticity of recovery will naturally expand outwards, in the process of recovery deformation, can be used to absorb heating and thermal expansion hot water and rising water vapor which are within the heating container 50, so that the adjusting bag 10 in the restoration of the original state can absorb more water, and hot water injection will be slowly, because of the principle of thermal expansion and cold shrink, and make the volume shrink, the same can increase negative pressure within the heating container 50. It can greatly improve the inflated water storage device 100 of the heater 200 latching tight, to avoid the phenomenon of dripping water of the outlet 61, but also can effectively prevent the heat loss within heating container 50, and achieve the practical effect of energy saving and power saving.

It is worth mentioning that when the water within the heating container 50 is heated, the high temperature vapor generated by boiling evaporates upward, and will naturally pass through the inlet pipeline 40, the connection tube body 20, and the junction tube 11, than is transmitted in the storage cavity 15 of the adjusting bag 10, to recover steam heat energy, and natural heat energy heating to maintain water temperature in the storage cavity 15 of the adjusting bag 10, in order to store energy, effectively shorten the heating time of water within the heating container 50.

Compared with the existing prior Arts technology, the inflated water storage device 100 of the present creation heater only needs to adjust the adjusting bag 10 with a connection tube body 20 can be operated, the overall structure design is convenient for exquisite and simple assembly, can completely overcome the prior arts about the complex structure, many parts, high cost, assembly is very troublesome shortcomings. The advantage of the present application is that when the outlet unit 60 of the heating container 50 is opened, the cold water in the connection tube body 20 quickly pass through, and flow to the inlet pipeline 40, water and air in the storage cavity 15 of the adjusting bag 10 will be sucked out, and be formed a vacuum, which causes the adjusting bag 10 to contract and deform. And when the outlet unit 60 is closed, the storage cavity 15 will naturally form a negative pressure, which can be used to recover the hot water and water vapor that is hotly expanded by heating within the heating container 50. And make the adjusting bag 10 storage water to be inflated and deformed, therefore, using simple and effective structure can achieve energy saving and drip-proof practical effect.

To sum up, the novel and practical creation fully conforms to the patent requirements, and the new patent application is submitted. However, the mentioned foregoing, only the preferable embodiment of this creation, but it is not possible to limit the scope of implementation of the present creation, so all according to the scope of patent application for the present creation and the contents of the present creation specification, made the equivalent changes and modifications, which should be covered by the present creative patent.

What is claimed is:

1. An inflated water storage device of a heater which is located on a heating container, including: an adjusting bag and a connection tube body, wherein the heating container is connected with an inlet pipeline and an outlet unit, the adjusting bag, which is correspondingly located on a heating container, has a storage cavity made of a soft elastic material; and the connection tube body, the two ends of which are respectively connected with an inlet and an outlet to be connected to the inlet pipeline on the heating container, and the connection tube body has a circulation tube connected with the storage cavity in the adjusting bag;

wherein the adjusting bag is further set up to be a streamlined concave shape in a bag manner integrated into a single structure, comprising: an upper bag surface, a bottom bag surface, an outer bag surface, and a concave bag surface;

wherein the bottom bag surface is tilted from high position inside near the concave bag surface to low position outside near the outer bag surface, so that different deformation height is on both sides in the storage cavity;

wherein the connection tube body is a Venturi tube, the connection tube body has a neck portion at an adjacent position of the circulation tube toward the side of the inlet, wherein the diameter of the neck portion is less than the diameter of the connection tube body.

2. The inflated water storage device of a heater as claimed in claim 1, wherein the storage cavity of the adjusting bag is further provided with a junction tube to be connected to the circulation tube.

3. The inflated water storage device of a heater as claimed in claim 2, wherein the adjusting bag further has an accommodating-tube portion clamped on a pipeline of the outlet unit.

4. The inflated water storage device of a heater as claimed in claim 3, wherein the adjusting bag is further set up to have a C-shape body, a junction tube is located in the outer bag surface, and an accommodating-tube portion is located in the concave bag surface.

5. The inflated water storage device of a heater as claimed in claim 1, wherein a cross section of the adjusting bag is trapezoidal.

* * * * *